United States Patent [19]

Hushbeck

[11] 4,324,293

[45] Apr. 13, 1982

[54] CIRCULATION VALVE

[75] Inventor: Donald F. Hushbeck, Duncan, Okla.

[73] Assignee: Halliburton Services, Duncan, Okla.

[21] Appl. No.: 145,319

[22] Filed: Apr. 29, 1980

[51] Int. Cl.[3] ..... E21B 34/10; E21B 43/12; F16K 17/40

[52] U.S. Cl. ..... 166/317; 137/70; 166/264; 166/321; 166/324

[58] Field of Search ..... 166/317, 319, 264, 321, 166/324; 137/68 R, 70, 71, 797; 175/317

[56] References Cited

U.S. PATENT DOCUMENTS

| | | | |
|---|---|---|---|
| 3,823,773 | 7/1974 | Nutter | 166/152 X |
| 3,850,250 | 11/1974 | Holden et al. | 166/315 |
| 3,930,540 | 1/1976 | Holden et al. | 166/315 |
| 3,970,147 | 7/1976 | Jessup et al. | 166/250 |
| 4,063,593 | 12/1977 | Jessup | 166/317 |
| 4,064,937 | 12/1977 | Barrington | 166/162 |
| 4,270,610 | 6/1981 | Barrington | 166/317 |

*Primary Examiner*—Stephen J. Novosad
*Attorney, Agent, or Firm*—John H. Tregoning; James R. Duzan; Lucian Wayne Beavers

[57] ABSTRACT

A reverse circulation valve includes a cylindrical housing having an open longitudinal passageway disposed therethrough and a circulating port and a power port disposed through a wall thereof. A valve mandrel is slidably received in the housing and movable from a closed position closing the circulating port to an open position opening the circulating port. The valve mandrel includes an annular piston received in the housing for moving the valve mandrel from its closed position to its open position. The power port communicates the piston with a pressure exterior of the housing. A frangible restraining structure is located between the valve mandrel and the cylindrical housing for restraining movement of the valve mandrel from its closed position to its open position until the pressure exterior of the housing exceeds a predetermined value, and for frangibly releasing the valve mandrel when said pressure exterior of the housing exceeds said predetermined value. The frangible restraining structure includes a carrying structure arranged for force transmitting engagement with a surface of the valve mandrel. The carrying structure includes inner and outer concentric sleeves with the inner sleeve being arranged for said force transmitting engagement with the surface of the valve mandrel. Shear pins are connected between the inner and outer concentric sleeves and arranged to be sheared upon relative longitudinal movement between the inner and outer cylindrical sleeves.

5 Claims, 3 Drawing Figures

CIRCULATION VALVE

Figure 1:
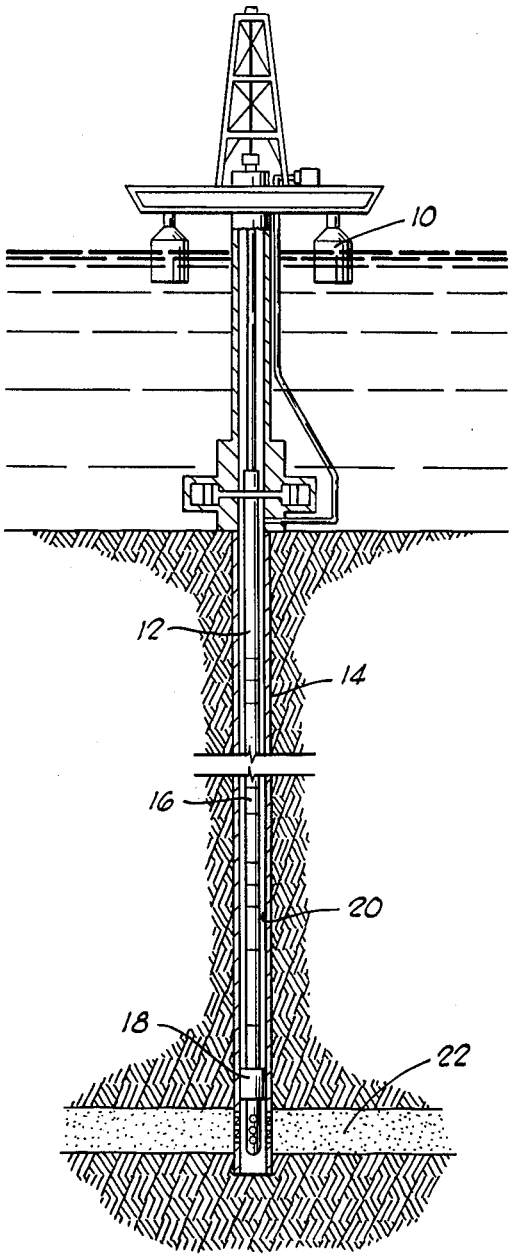

This invention relates generally to an apparatus for testing an oil well, and more particularly, but not by way of limitation, to a reverse circulation valve operating in response to annulus pressure.

The present invention is an improved version of an annulus pressure responsive reverse circulation valve disclosed in U.S. Pat. No. 3,970,147 to Jessup, et al and assigned to the assignee of the present invention.

The Jessup, et al patent discloses a sliding sleeve type reverse circulation valve which operates in response to annulus pressure acting upon an annular piston attached to the sliding valve member. The Jessup, et al device includes shear pin means which are directly connected to the sliding valve member by being disposed in radial holes in the valve member.

With the shear pin arrangement of Jessup, et al, a problem is sometimes encountered when the drill pipe string to which the circulating valve is attached is repeatedly tested by internal pressurization during the assembly and lowering of the same into the well. This internal pressurization of the sliding valve member of the circulating valve to the very high pressures often encountered during such drill pipe testing causes the sliding valve member to flex and this flexure of the sliding valve member sometimes affects the load carrying capabilities of the shear pins which are directly attached to the sliding valve member.

These problems are eliminated by the present invention which replaces the shear pin arrangement of Jessup, et al with a plurality of shear pins disposed in a carrying structure which is arranged for force transmitting engagement with a surface of the sliding valve member, but which does not have the shear pins directly attached to the sliding valve member. This prevents premature working of the shear pins due to flexure of the sliding valve member during internal pressurization of the drill pipe string.

A shear pin arrangement similar to that of the present invention is disclosed in U.S. patent application Ser. No. 112,210 filed Jan. 15, 1980, now U.S. Pat. No. 4,270,610, for Annulus Pressure Operated Closure Valve with Improved Power Mandrel, of Barrington, assigned to the assignee of the present invention. The shear pin arrangement of Barrington, however, is not directly engaged with a sliding valve member of a reverse circulation valve, and also is differently arranged with respect to the present invention as concerns the source of pressurized fluid directly contacting the carrying structure and the balancing of such fluid pressures longitudinally across the carrying structure.

Other prior art references relate generally to annulus pressure responsive valves for use in testing oil wells. For example, U.S. Pat. No. 3,850,250 and U.S. Pat. No. 3,930,540, both to Holden, et al, and assigned to the assignee of the present invention, disclose a circulation valve which opens after a predetermined number of annulus pressure changes have been applied to the well annulus.

U.S. Pat. No. 4,064,937 to Barrington, and assigned to the assignee of the present invention, discloses a closure valve for use in oil well testing which provides a full opening flow passage therethrough, and which includes a reverse circulation valve. The circulation valve of Barrington is arranged and constructed such that a sliding valve mandrel is movable from a normally closed position closing a circulation port to a normally open position opening the circulation port. Attached to the valve mandrel are a plurality of spring fingers which are initially held against a ledge of a housing by close engagement with a power mandrel. After movement of the power mandrel through a predetermined distance, the heads of the spring fingers are allowed to contract into a reduced diameter part of the power mandrel, thereby releasing the valve mandrel and allowing it to be moved downward to its open position. That downward movement is accomplished by expansion of a coil compression spring.

U.S. Pat. No. 3,823,773 to Nutter, discloses a circulation valve which is an integral part of a sample mechanism when the sample mechanism opens and closes responsive to pressure changes in the well annulus. The circulation valve disclosed therein moves from a closed position to an open position after a predetermined number of operations of the sampler valve.

A dual CIP reverse circulating valve offered by Halliburton Services of Duncan, Okla., is a reverse circulation valve in which spring loaded fingers hold a sliding sleeve mandrel in a position covering the reverse circulation ports in a housing of the valve. The sleeve mandrel is spring loaded toward open position. The dual CIP reverse circulating valve is operated by drill pipe rotation wherein rotation advances an operating mandrel which also opens and closes a tester valve mechanism. After a predetermined number of rotations, the tester valve is closed and additional rotation activates a releasing mechanism which releases the mechanism holding the sliding sleeve valve mandrel. The sliding sleeve valve mandrel is then moved to the open position by the mentioned spring, thereby uncovering the circulating ports to allow reverse circulation.

The reverse circulation valve of the present invention includes a cylindrical housing having an open longitudinal passageway disposed therethrough and a circulating port and a power port disposed through a wall thereof. A valve mandrel is slidably received in the housing and movable from a closed position closing the circulating port to an open position opening the circulating port.

The valve mandrel includes an annular piston means received in the housing for moving the valve mandrel from its closed position to its open position. The power port means disposed through the wall of the housing provides a means for communicating the piston with a pressure exterior of the housing.

A frangible restraining means is located between the valve mandrel and the cylindrical housing for restraining movement of the valve mandrel from its closed position to its open position until the pressure exterior of the housing exceeds a predetermined value, and for frangibly releasing the valve mandrel when said pressure exterior of the housing exceeds said predetermined value.

The frangible restraining means includes a carrying structure arranged for force transmitting engagement with a surface of the valve mandrel. The carrying structure includes inner and outer concentric sleeves with the inner sleeve being arranged for said force transmitting engagement with the surface of the valve mandrel. Shear pin means are connected between the inner and outer concentric sleeves and arranged to be sheared upon relative longitudinal movement between the inner and outer cylindrical sleeves.

The carrying structure is in fluid isolation from the longitudinal passageway of the housing, and is pressure balanced with regard to pressurized fluid exterior of the housing which is directly communicated with the carrying structure through an exterior pressure balance passage means.

Numerous objects, features and advantages of the present invention will be readily apparent to those skilled in the art from the following disclosure when taken in conjunction with the accompanying drawings.

FIG. 1 is a schematic elevation view of a well test string, utilizing the reverse circulating valve of the present invention, in place within a subsea oil well.

Figure 2A:
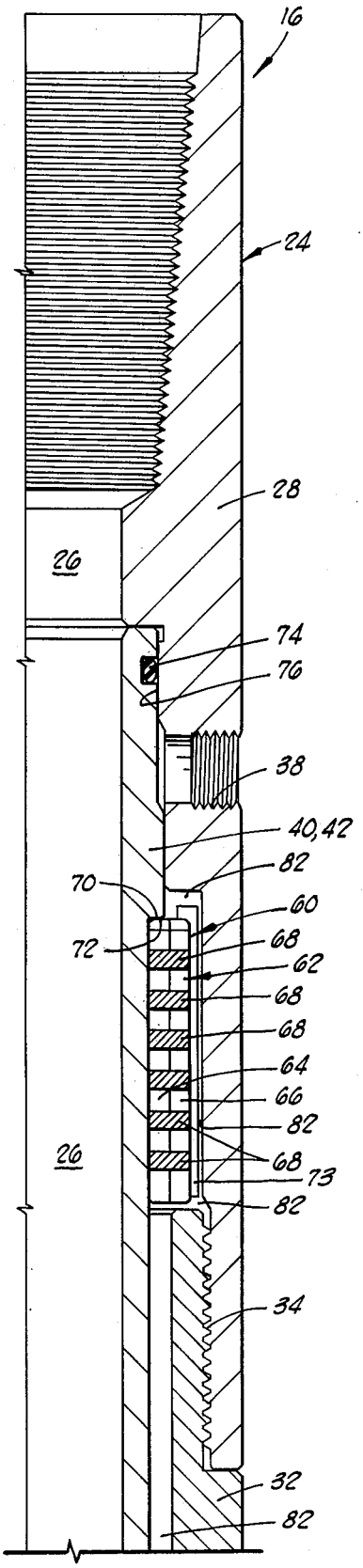
Figure 2B:
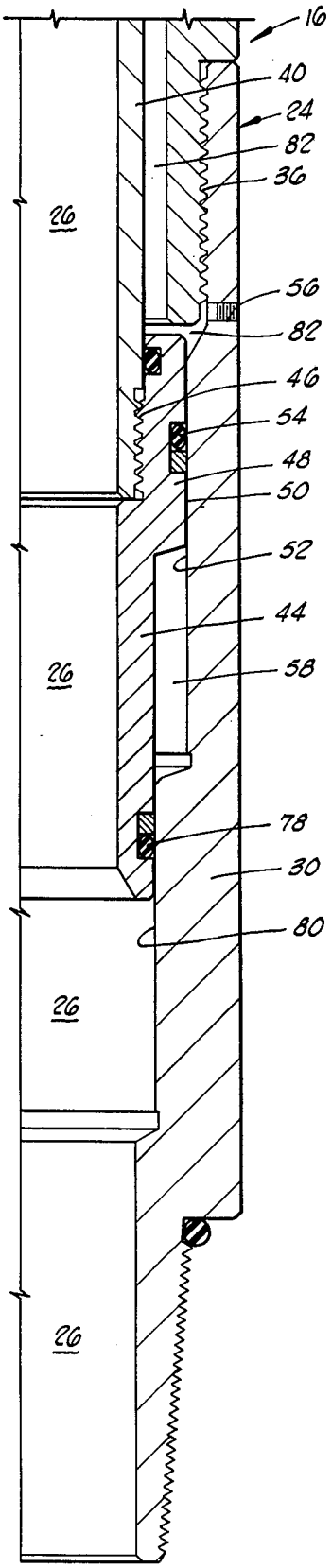

FIGS. 2A and 2B comprise an elevation right side only section view of the reverse circulating valve of the present invention, showing the valve mandrel in its closed position.

During the course of drilling an oil well, the bore hole is filled with a fluid known as drilling fluid or drilling mud. One of the purposes of this drilling fluid is to maintain in intersected formations, any formation fluid which may be found therein. To contain these formation fluids, the drilling mud is weighted with various additives so that the hydrostatic pressure of the mud at the formation depth is sufficient to maintain the formation fluid within the formation without allowing it to escape into the bore hole.

When it is desired to test the production capabilities of the formation, a testing string is lowered into the bore hole to the formation depth, and the formation fluid is allowed to flow into the string in a controlled testing program. Lower pressure is maintained in the interior of the testing string as it is lowered into the borehole. This is usually done by keeping a formation tester valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is open, formation fluid in the testing string is circulated out, the packer is released and the testing string is withdrawn.

The present invention particularly relates to improvements in circulating valves for use in a testing string as just described.

Referring now to FIG. 1, a typical arrangement for conducting a drill stem test offshore is shown. The general arrangement of such a well test string is well known in the art and is shown, for example in U.S. Pat. No. 4,064,937 to Barrington, the details of which are incorporated herein by reference.

Of particular significance to the present invention, FIG. 1 shows a floating work station 10 from which a well test string 12 is suspended in a subsea well defined by well casing 14. Near the lower end of the test string 12 there is located therein a reverse circulating valve 16 of the present invention. Below the circulating valve 16 there is located a conventional packer means 18 for sealing an annulus 20 between the well test string 12 and the well casing 14 above the underground formation 22 which is being tested.

Referring now to FIGS. 2A and 2B, a right side only section elevation view of the circulating valve 16 of the present invention is thereshown.

The circulating valve 16, which may also be referred to as a circulation valve, includes a cylindrical housing 24 having an open longitudinal passageway or axial bore 26 therethrough.

The cylindrical housing 24 comprises an upper adapter 28, a lower adapter 30, and a middle cylindrical housing member 32. An upper end of middle housing member is attached to upper adapter 28 at threaded connection 34, and a lower end of middle housing member 32 is attached to lower adapter member 30 at threaded connection 36.

Upper adapter 28 of cylindrical housing 24 includes a circulating port or passageway 38 disposed radially through a wall thereof.

A valve mandrel or valve body 40 is slidably received in housing 24 and movable from a closed position, as illustrated in FIGS. 2A and 2B closing circulating port 38, to an open position, with the mandrel moved downward from the position shown in FIGS. 2A and 2B, opening circulating port 38.

The valve mandrel 40 includes an upper valve mandrel portion 42 and a lower valve mandrel portion 44 threadedly connected at threaded connection 46.

Defined on lower valve mandrel portion 44 of valve mandrel 40 is an annular piston means 48 which has an outer surface 50 closely received within a cylindrical inner surface 52 of lower adapter 30. Annular seal means 54 seal between piston 48 and inner cylindrical surface 52.

Disposed in a wall of lower adapter 30 is a power port means 56 for communicating piston 48 with a pressure exterior of housing 24 within the annulus 20 (see FIG. 1).

The piston means 48 provides a means for moving the valve mandrel 40 from its closed position to its open position in response to pressure in the annulus 20 communicated to the piston 48 through the power port 56.

An annular zone 58 below piston 48 is a lower pressure zone, containing approximately atmospheric pressure, and when higher pressure is communicated with the top surface of piston 48 through the power port 56, the pressure forces acting on piston 48 will move the piston 48 downwards relative to housing 24.

Located between valve mandrel 40 and cylindrical housing 24 is a frangible restraining means generally designated by the numeral 60. Frangible restraining means 60 is a means for restraining movement of valve mandrel 40 from its closed position to its open position until said pressure exterior of housing 24 within annulus 20 exceeds a predetermined value, and for frangibly releasing valve mandrel 40 when said pressure exterior of housing 24 exceeds a predetermined value.

The frangible restraining means 60 may also be described as a locking means 60 for locking the valve mandrel 40 in its first closed position, and for unlocking the valve mandrel 40 from housing 24 when the predetermined pressure in annulus 20 is reached.

The frangible restraining means 60 includes a carrying structure 62 which in turn includes inner and outer concentric sleeves 64 and 66, respectively. Frangible restraining means 60 further includes a plurality of shear pin means 68 connected between inner and outer concentric sleeves 64 and 66 and arranged to be sheared upon relative longitudinal movement between inner and outer concentric sleeves 64 and 66.

The pressure in annulus 20 required to shear the shear pins 68 depends upon the number, size and material of construction of the shear pins 68.

Inner concentric sleeve 64 of carrying structure 62 of frangible restraining means 60 includes an upper end surface 70 arranged for force transmitting engagement with a downward facing annular surface 72 of valve mandrel 40.

A retainer sleeve means 73 is disposed about outer concentric sleeve 66 for holding the shear pin means 68 in place within the carrying structure 62.

An annular seal 74 seals between an upper end of valve mandrel 40 and an inner cylindrical surface 76 of upper adapter 28 of valve housing 24. An annular seal 78 seals between a lower end of valve mandrel 40 and an inner cylindrical surface 80 of lower adapter 30.

By means of seals 74 and 78, the carrying structure 62 of frangible restraining means 60 is isolated from fluid pressure in longitudinal passageway 26 of housing 24.

The carrying structure 62 is in direct fluid contact with pressurized fluid from the annulus 20 by means of a flow passageway 82 which is designated in FIGS. 2A and 2B by a plurality of designations 82 showing the path by which fluid is communicated from the power port 56 to the carrying structure 62.

This passage 82 may be described an an exterior pressure balance means for communicating the pressure exterior of housing 24 with the carrying structure 62, and for balancing said exterior pressure, and a longitudinal force caused thereby, across said carrying structure 62 to prevent longitudinal loading of the shear pin means 68 due to said exterior pressure acting directly on carrying structure 62.

The importance of this pressure balance means is better appreciated if one considers the other possible manners in which the carrying structure 62 could be arranged. For example, if a lower surface of the carrying structure 62 were directly exposed to pressurized fluid from the annulus 20, but the carrying structure 62 was so tightly fit between the valve mandrel 40 and the valve housing 24 that this exterior fluid was not fully communicated with the upper surface of the carrying structure 62, a pressure imbalance would be created longitudinally across the carrying structure 62 which could exert shearing type forces on the shear pin means 68. This would create problems with being able to accurately predict the pressure within annulus 20 at which the frangible restraining means 60 would release the valve mandrel 40.

As can be seen in FIGS. 2A and 2B, the carrying structure 62 is located on the same side, i.e. the upper side, of piston means 48 as is the power port 56. The carrying structure 62 is also located between power port 56 and circulating port 38.

The manner of operation of the reverse circulating valve 16 of the present invention is generally as follows.

The well test string is lowered into the well casing 14 as shown in FIG. 1 until the lower end of the well test string is adjacent the subsurface formation 22 to be tested. Then the packer means 18 is expanded to seal the annulus 20 between the test string 12 and the casing 14 so as to isolate a portion of annulus 20 above packer 18. The well testing procedures previously described are then carried out. When it is desired to open the circulating valve 16 and circulate fluids from the annulus 20 through the circulating valve 16 into the well test string 12, the pressure in annulus 20 is raised to a predetermined level dependent upon the design of the shear pin means 68 as previously described, and that pressure from the annulus 20 acting through power port 56 on piston means 48 exerts a downward force on valve mandrel 40 which in turn exerts a downward force on inner concentric sleeve 64 through the engagement of surfaces 70 and 72. This applies a shearing force on the shear pins 68 and causes those shear pins to be sheared upon relative longitudinal movement between inner and outer concentric sleeves 64 and 66.

The normal hydrostatic pressure of well fluid within the annulus 20 is maintained in communication with upper end of piston 48 through power port 56 and thereby maintains the valve mandrel 40 in its closed position in response to said normal hydrostatic pressure.

Thus, the circulating valve of the present invention is well adapted to attain the ends and advantages mentioned as well as those inherent therein. While presently preferred embodiments of the invention have been described for the purpose of this disclosure, numerous changes in the construction and arrangement of parts can be made by those skilled in the art, which changes are encompassed in the scope of this invention as defined by the appended claims.

What is claimed is:

1. A circulation valve, comprising:

a cylindrical housing having an open longitudinal passageway therethrough, a circulation port disposed through a wall of said housing, and a power port means disposed through said wall of said housing;

a valve mandrel slidably received in said housing and movable from a closed position closing said circulation port to an open position opening said circulation port, said valve mandrel including an annular piston means received in said housing for moving said valve mandrel from its closed position to its open position, said power port means being a means for communicating said piston with a pressure exterior of said housing;

frangible restraining means between said valve mandrel and said cylindrical housing for restraining movement of said valve mandrel from its closed position to its open position until said pressure exterior of said housing exceeds a predetermined value, and for frangibly releasing said valve mandrel when said pressure exterior of said housing exceeds said predetermined value, said frangible restraining means including a carrying structure arranged for force transmitting engagement with a surface of said valve mandrel; and wherein said power port is located above said piston means, said carrying structure is located above said power port, and said circulation port is located above said carrying structure.

2. The circulation valve of claim 1, wherein:

said carrying structure includes inner and outer concentric sleeves, said inner sleeve being arranged for said force transmitting engagement with said surface of said valve mandrel; and said frangible restraining means further includes shear pin means connected between said inner and outer concentric sleeves and arranged to be sheared upon relative longitudinal movement between said inner and outer concentric sleeves.

3. The circulation valve of claim 2, wherein:

said carrying structure is isolated from fluid pressure in said longitudinal passageway of said housing.

4. The circulation valve of claim 3, further comprising:

exterior pressure balance means for communicating said pressure exterior of said housing with said carrying structure, and for balancing said exterior pressure, and a longitudinal force caused thereby, across said carrying structure to prevent longitudinal loading of said shear pin means due to said exterior pressure acting directly on said carrying structure.

5. The circulation valve of claim 2, further comprising:

retainer sleeve means disposed about said outer concentric sleeve of said carrying structure for holding said shear pin means in place within said carrying structure.

* * * * *

UNITED STATES PATENT AND TRADEMARK OFFICE

CERTIFICATE OF CORRECTION

PATENT NO. : 4,324,293

DATED : April 13, 1982

INVENTOR(S) : Donald F. Hushbeck

It is certified that error appears in the above—identified patent and that said Letters Patent is hereby corrected as shown below:

On the Title page Item [73] Assignee delete "Services" and insert --Company--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*